US010549937B2

(12) United States Patent
Schalk et al.

(10) Patent No.: US 10,549,937 B2
(45) Date of Patent: Feb. 4, 2020

(54) DEVICE INCLUDING SEPARATOR

(71) Applicant: Hewlett-Packard Development Company, L.P., Houston, TX (US)

(72) Inventors: Wesley R Schalk, Camas, WA (US); Sam Sing, Vancouver, WA (US); Jeffrey G Bingham, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 15/763,519

(22) PCT Filed: Jan. 29, 2016

(86) PCT No.: PCT/US2016/015830
§ 371 (c)(1),
(2) Date: Mar. 27, 2018

(87) PCT Pub. No.: WO2017/131785
PCT Pub. Date: Aug. 3, 2017

(65) Prior Publication Data

US 2018/0273317 A1 Sep. 27, 2018

(51) Int. Cl.
*B65H 3/52* (2006.01)
*B65H 3/06* (2006.01)

(52) U.S. Cl.
CPC ..... *B65H 3/0684* (2013.01); *B65H 3/06* (2013.01); *B65H 3/5215* (2013.01);
(Continued)

(58) Field of Classification Search
CPC .. B65H 3/0684; B65H 3/5261; B65H 3/5215; B65H 3/5223
See application file for complete search history.

(56) References Cited

U.S. PATENT DOCUMENTS 4,606,535 A 8/1986 Larson
5,183,248 A * 2/1993 Okada ..... B65H 1/04 271/121

(Continued)

FOREIGN PATENT DOCUMENTS

| | | |
|---|---|---|
| EP | 1466849 | 10/2004 |
| EP | 2354061 | 8/2011 |
| JP | H-1171036 | 3/1999 |

OTHER PUBLICATIONS

Bryce. 5K-LE Owners Manual P/N 90-00852-001 Revision A. Bryce Office Systems. Newtown, CT.—Date Unknown—129 pages.

*Primary Examiner* — Patrick Cicchino
(74) *Attorney, Agent, or Firm* — HP Inc. Patent Department

(57) ABSTRACT

Examples disclosed herein relate to a device including a separator. Examples include a first separator having a surface to contact a medium and is coupled to a first spring. In examples, the first separator has a first centerline in a direction perpendicular to a medium travel direction. Examples include a second separator having a surface to contact a medium and is coupled to a second spring. In examples, the second separator has a second centerline disposed substantially parallel to the first centerline. Examples include a roller to contact the medium to move the medium along the medium travel direction. In examples, the first spring and second spring bias the first separator and second separator towards the roller, respectively. In examples, a force applied by the first separator to the medium is independent of a force applied to the medium by the second separator.

15 Claims, 7 Drawing Sheets

(52) U.S. Cl.
CPC ..... *B65H 3/5223* (2013.01); *B65H 3/5261* (2013.01); *B65H 2402/54* (2013.01)

(56) References Cited

U.S. PATENT DOCUMENTS

| | | | | |
|---|---|---|---|---|
| 5,277,417 | A * | 1/1994 | Moritake | B65H 3/5223 271/121 |
| 5,374,047 | A | 12/1994 | Tsukamoto et al. | |
| 5,549,289 | A | 8/1996 | Sonnenburg et al. | |
| 5,575,467 | A | 11/1996 | Williams | |
| 6,170,701 | B1 * | 1/2001 | Youn | B65H 3/0653 221/126 |
| 6,543,761 | B2 * | 4/2003 | Endo | B65H 3/5223 271/110 |
| 7,100,914 | B2 | 9/2006 | Ramos | |
| 7,401,774 | B2 | 7/2008 | Ginzton | |
| 7,866,658 | B2 * | 1/2011 | Bokelman | B65H 3/0684 271/117 |
| 8,141,866 | B2 * | 3/2012 | Okawa | B65H 3/0684 271/121 |
| 8,622,381 | B2 | 1/2014 | Aoki et al. | |
| 8,733,755 | B2 * | 5/2014 | Taniguchi | B65H 3/06 271/121 |
| 8,757,612 | B2 | 6/2014 | Tsai | |
| 8,757,616 | B2 * | 6/2014 | Arimura | H04N 1/00628 271/117 |
| 9,248,986 | B2 * | 2/2016 | Aoki | B65H 5/26 |
| 9,776,815 | B2 * | 10/2017 | Taguchi | B65H 3/06 |
| 9,796,542 | B2 * | 10/2017 | Shiohara | B65H 3/0684 |
| 9,856,099 | B2 * | 1/2018 | Aoyama | B65H 3/06 |
| 9,884,737 | B2 * | 2/2018 | Ito | B65H 3/0684 |
| 2001/0028141 | A1 | 10/2001 | Kotaka et al. | |
| 2006/0180992 | A1 * | 8/2006 | Asada | B65H 3/0661 271/121 |
| 2006/0202405 | A1 | 9/2006 | Shyu et al. | |
| 2011/0133394 | A1 | 6/2011 | Morikawa et al. | |
| 2011/0221123 | A1 * | 9/2011 | Otani | B65H 1/266 271/171 |
| 2014/0062000 | A1 * | 3/2014 | Taguchi | B65H 3/06 271/109 |
| 2018/0237240 | A1 * | 8/2018 | Sugimoto | B65H 1/04 |

* cited by examiner

DEVICE INCLUDING SEPARATOR

BACKGROUND

Many devices accept inputs of multiple pieces of media and generally process a single piece of media at a time. For example, printers may include an input tray which accepts more than one piece of paper as the media. In other examples, a scanner may include an automatic document feeder to accept multiple sheets of paper as the media. The automatic document feeder may provide an individual sheet of the media to the scanner.

BRIEF DESCRIPTION OF THE DRAWINGS

The following detailed description references the drawings, wherein.

DETAILED DESCRIPTION

In the following discussion and in the claims, the term "couple" or "couples" is intended to include suitable indirect and/or direct connections. Thus, if a first component is described as being coupled to a second component, that coupling may, for example, be: (1) through a direct electrical or mechanical connection, (2) through an indirect electrical or mechanical connection via other devices and connections, (3) through an optical electrical connection, (4) through a wireless electrical connection, and/or (5) another suitable coupling. The term "approximately" as used herein to modify a value is intended to be determined based on the understanding of one of ordinary skill in the art, and can, for example, mean plus or minus up to 20% of that value.

The number of pieces of media that may be loaded into an electronic device for use may vary. The speed at which electronic devices process the media has been increasing. For example, printing speeds and scanning speeds of devices are increasing. However, most electronic devices process a single piece of media at a time. There is a need to consistently pick one piece of media for processing by the electronic device. For example, a printer may have an input tray to accept hundreds of sheets of paper but will need to pick a single sheet of paper from the input tray at a time for printing. Various pick mechanisms have been developed to pick a single medium from a stack of media. However, such pick mechanisms may fail resulting in more than one piece of the media entering the device for processing.

To address these issues, in the examples described herein, a device is described which includes a separation unit to separate media for processing. The separation unit includes two independent separator biased towards a roller by two independent springs. The roller may move media along a media travel direction to separate a medium from the media. A separation force applied by the first separator to the medium is independent of a separation force applied by the second separator which may increase media pick accuracy.

Figure 1:
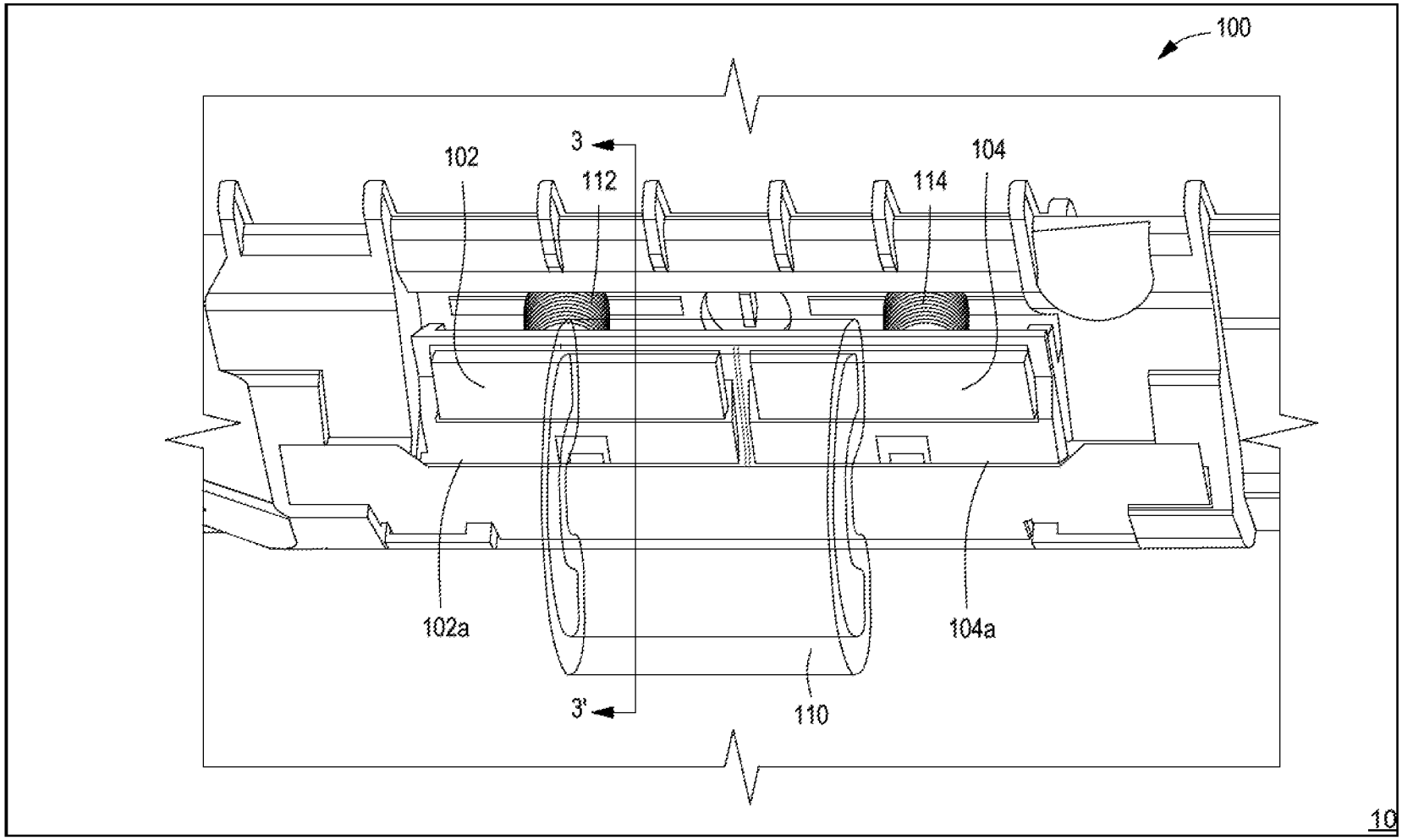
FIG. 1 is a diagram of a device including a schematic front perspective view of a separation unit according to an example.
Figure 2:
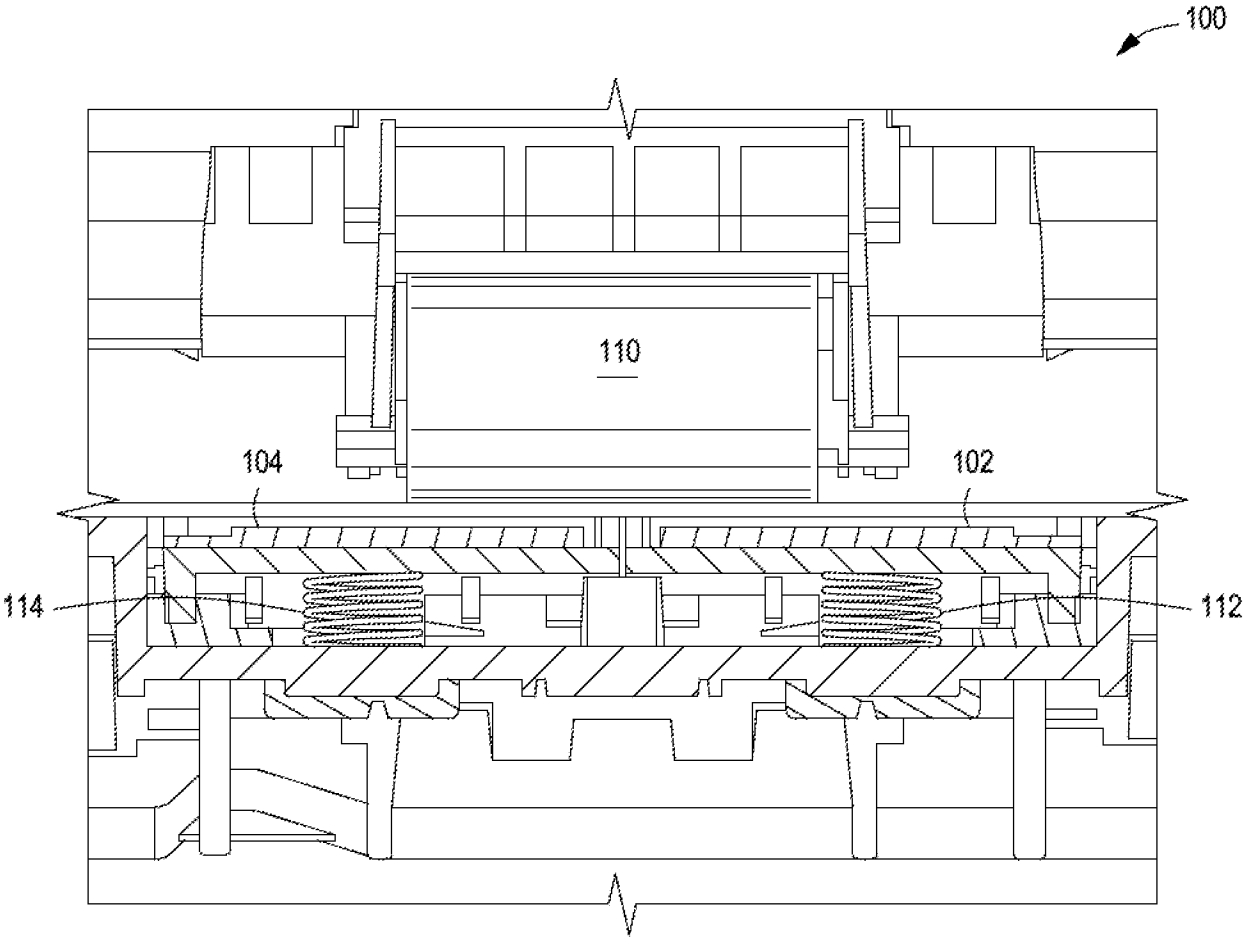
FIG. 2 is a top schematic view of the separation unit of FIG. 1 according to an example.
Figure 3:
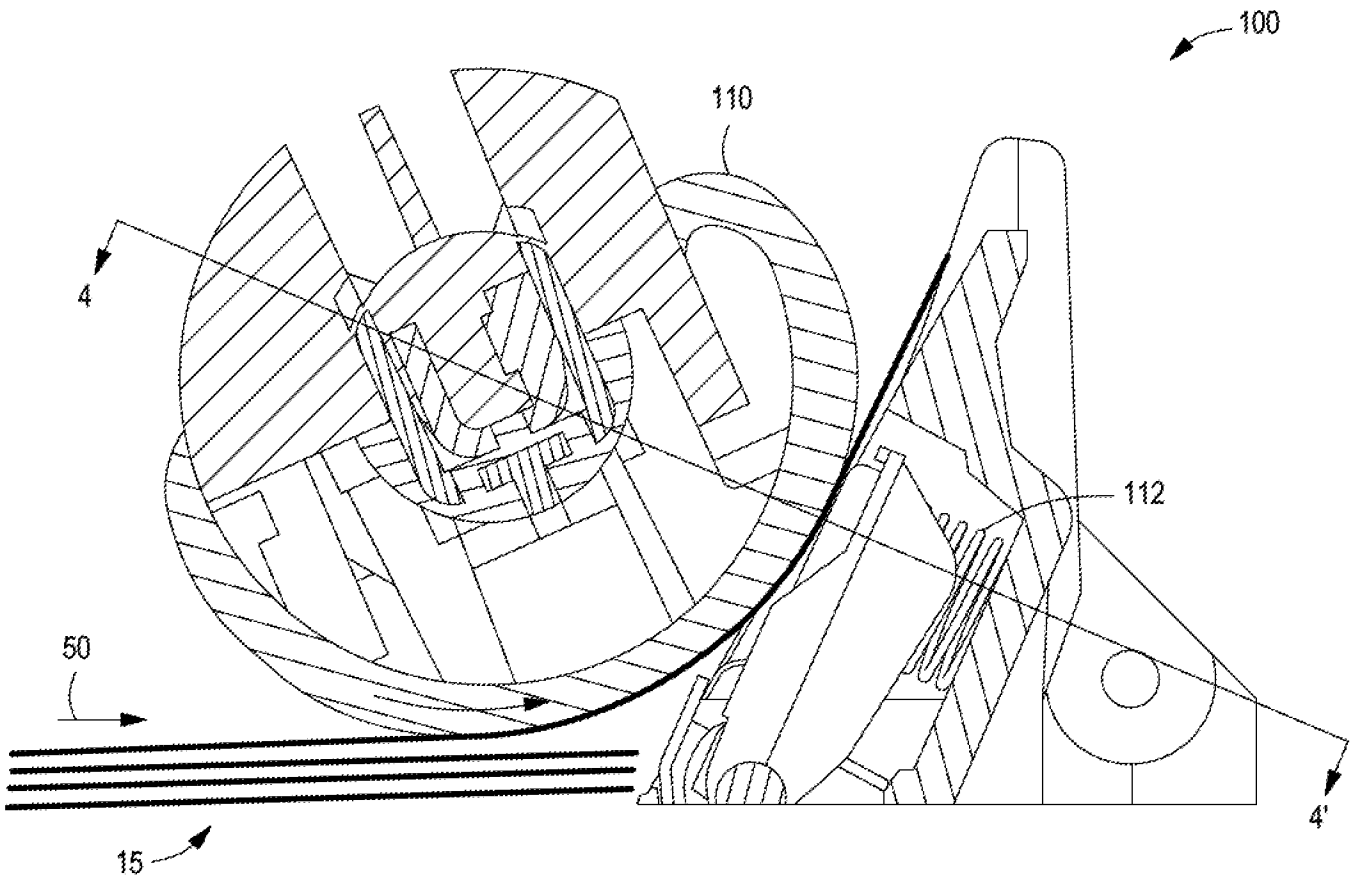
FIG. 3 is a side schematic view of the separation unit of FIG. 1 taken along line 3-3' according to an example.
Figure 4:
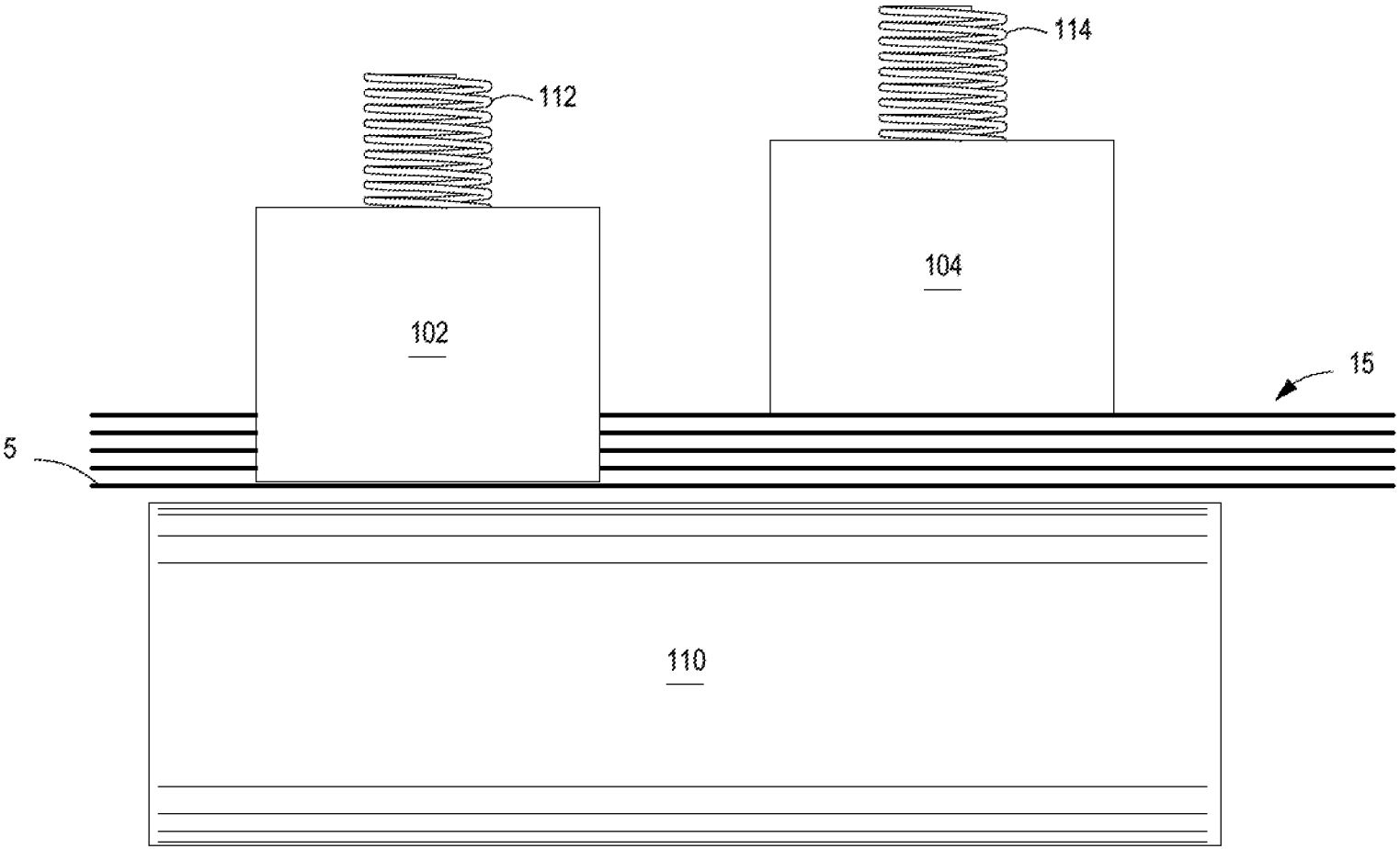
FIG. 4 is a top schematic view of a separation unit of FIG. 4 taken along line 4-4' according to an example.
Figure 5:
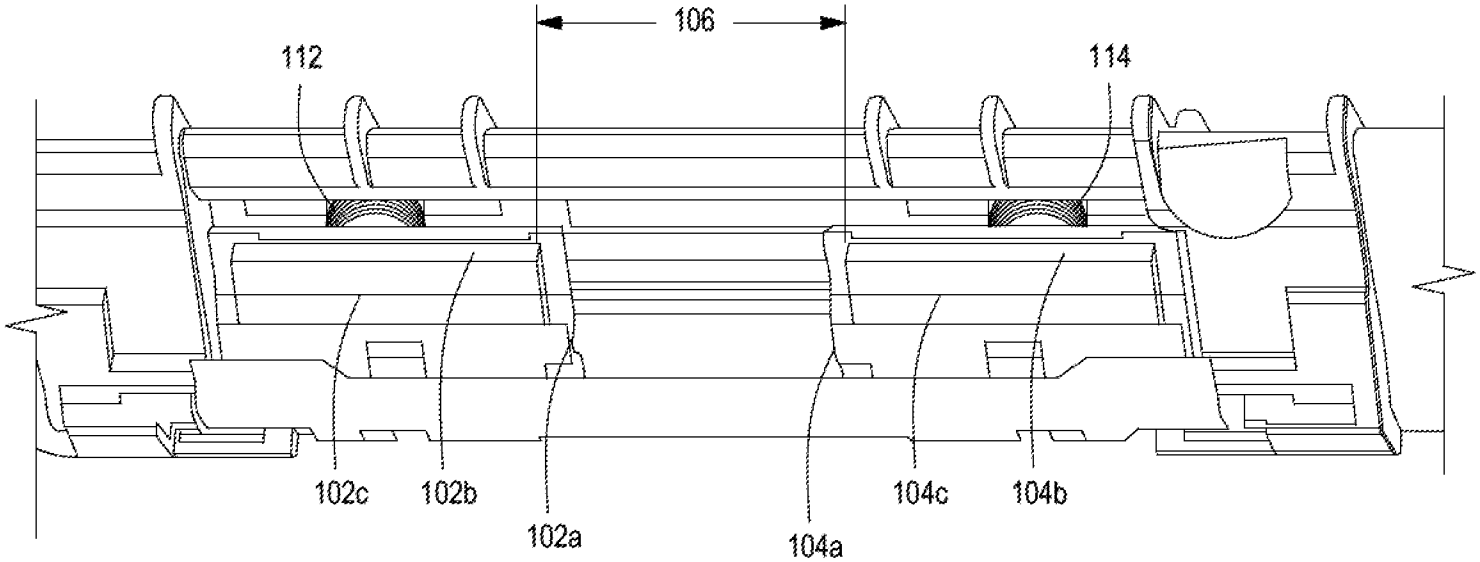
FIG. 5 is a partial perspective view of the separation unit of FIG. 1 according to an example.

Referring now to the drawings, FIG. 1 is a diagram of a device 10 including a schematic front perspective view of a separation unit 100 according to an example. FIG. 2 is a top schematic view of separation unit 100 of FIG. 1. FIG. 3 is a side schematic view of the separation unit 100 of FIG. 1 taken along line 3-3'. FIG. 4 is a top schematic view of a separation unit 100 of FIG. 3 taken along line 4-4'. FIG. 5 is a partial perspective view of the separation 100 unit of FIG. 1. In the examples of FIGS. 1-5. device 10 includes a separation unit 100 to receive media for separation. In examples, separation unit 100 includes roller 110, a separator 102, a separator 104, a spring 112, and a spring 114. In examples, media 15 are depicted traveling along a media travel direction (or medium travel direction) 50. In some examples, a medium 5 travels along media travel direction 50 and exits separation unit 100 after passing between roller 110 and separator 102 and/or separator 104.

In examples, device 10 may be any device to receive media and transport such media which may be stacked, such as a printer, a scanner, a fax machine, a finisher, etc. In examples, media 15 may be any type of media which may be stacked and includes medium 5 which may be received by device 10 and transported through separation unit 100. For example, media 15 may be any type of paper, fabric, plastic, envelop, card stock, etc., which may be stacked to be fed into device 10. In examples, separation unit 100 may receive more than one piece of media from another component of device 10, such as an input tray, and may be configured to separate the media such that a single medium emerges from separation unit 100 for processing by device 10. In some examples, device 10 may include a roller 110 to pick up the medium 5 from media 15 for transport along media travel direction 50.

In examples, roller 110 rotates about a central axis in the direction indicated by the arrow in FIG. 3. Roller 110 may be driven by a motor to contact media 15 and move media along media travel direction 50. In examples, medium 5 transported along media travel direction 50 may enter another zone of device 10 for processing, such as a printing zone, a scanning zone, etc. In some examples, the motor may be an electrically driven motor. Various parameters related to the motor may be selected for the particular use and design of device 10. For example, the power (or load) of the motor may be determined by the size of the device 10 and the particular use of the system.

In examples, spring 112 may be coupled to separator 102 to bias separator 102 towards roller 110 and spring 114 may be coupled to separator 104 to bias separator 104 towards roller 110. Spring 112 and spring 114 may be any type of spring to provide a spring force, such as tension spring, extension spring, compression spring, torsion spring, constant spring, variable spring. In some examples, spring 112 and spring 114 may provide sufficient force to bias separator 102 and separator 104 to contact a first side of medium 5 as it travels along the media travel direction 50. In the examples, roller 110 may contact the opposite side of medium 5 as it travels along the media travel direction 50.

In some examples, separator 102 and separator 104 may be any component with a surface area to engage or contact medium 5 as it travels through media travel direction 50. In examples, separator 102 and separator 104 may be a separation pad with a first surface to contact medium 5. In such examples, the surfaces of separator 102 and separator 104 in contact with medium 5 may be a substantially flat or curved surface to contact a surface area of medium 5. In some examples, separator 102 and separator 104 may be substantially the same size and shape. In other examples, separator 102 and separator 104 may be of different size and shape. In the example of FIGS. 1-5, separator 102 and separator 104 are substantially shaped as two different sized rectangular prisms coupled to each other. The smaller rectangular prism may be disposed to contact medium 5 as it travels along media travel direction 50. In such examples, a surface of the larger rectangular prism of separator 102 and/or second separator 104 may initially contact medium 5 as it travels along media travel direction 50 and then a surface of the smaller rectangular prism of separator 102 and/or separator 104 may contact medium 5.

In examples, a force applied by separator 102 and/or separator 104 to medium 5 may provide sufficient force to separate medium 5 from media 15 in combination with a force applied by roller 110. In the examples, the force applied by separator 102 and/or separator 104 to medium 5 is provided by spring 112 and spring 114 to separator 102 and separator 104, respectively. In such examples, the spring constant of spring 112 and spring 114 may be chosen to provide sufficient force to separate medium 5 from media 15. In examples, separator 102 and separator 104 are independent components of separation unit 100 such that a separation force applied by separator 102 to medium 5 is independent of separator 104. Similarly, a force applied by separator 104 to medium 5 is independent of a force applied to medium 5 by separator 102. In such an example, if one of separator 102 and separator 104 fails to provide a separation force to medium 5, the other one of separator 102 and separator 104 may continue to apply a separation force to medium 5. In such an example, a spring constant of spring 112 and spring 114 may be chosen to optimize the separation force applied by separator 102 and separator 104 to pick a single medium 5 from media 15 to exit separation unit 100. In the example of FIG. 4, a number of pieces of media 15 are depicted as having been caught or jammed in separator 104. In such an example, separator 102 may continue to apply sufficient separation force to a medium traveling between roller 110 and separator 102 to separate a single piece of the media (e.g., medium 5) from media 15 such that the separated medium (medium 5) may continue along media travel direction 50 to exit separation unit 100.

As depicted in the example of FIG. 5, separator 102 may include an edge 102*a* and edge 102*b* disposed perpendicular to media travel direction 50. A centerline 102*c* may be is depicted between edge 102*a* and 102*b* in FIG. 5. Similarly, separator 104 may include an edge 104*a* and edge 104*b* disposed perpendicular to media travel direction 50. A centerline 104*c* is depicted between edge 104*a* and 104*b* in FIG. 5. In the examples, separator 102 and separator 104 are disposed a distance 106 from each other. In some examples, distance 106 may be equal to or less than 20 mm. In such an example, distance 106 may be 2 mm. In other examples, distance 106 may be greater than 20 mm. In the example of FIG. 5, distance 106 between separator 102 and separator 104 is larger than distance 106 depicted in FIGS. 1-4.

Although depicted in FIGS. 1-5 as of similar shape and size, separator 102 and separator 104 are not limited thereto and may be of different size and or shape. In an example, separator 102 and separator 104 may be disposed such that centerline 102*c* and centerline 104*c* are approximately parallel to each other. In other examples, separator 102 and separator 104 may be positioned such that edge 102*a* and edge 104*a* are approximately parallel to each other. In yet another example, separator 102 and separator 104 may be positioned such that edge 102*b* and 104*b* are approximately parallel to each other. In some examples, components described herein in relation to FIGS. 1-5 may be provided in combination with components described herein in relation to any of FIGS. 6-7.

Figure 6:
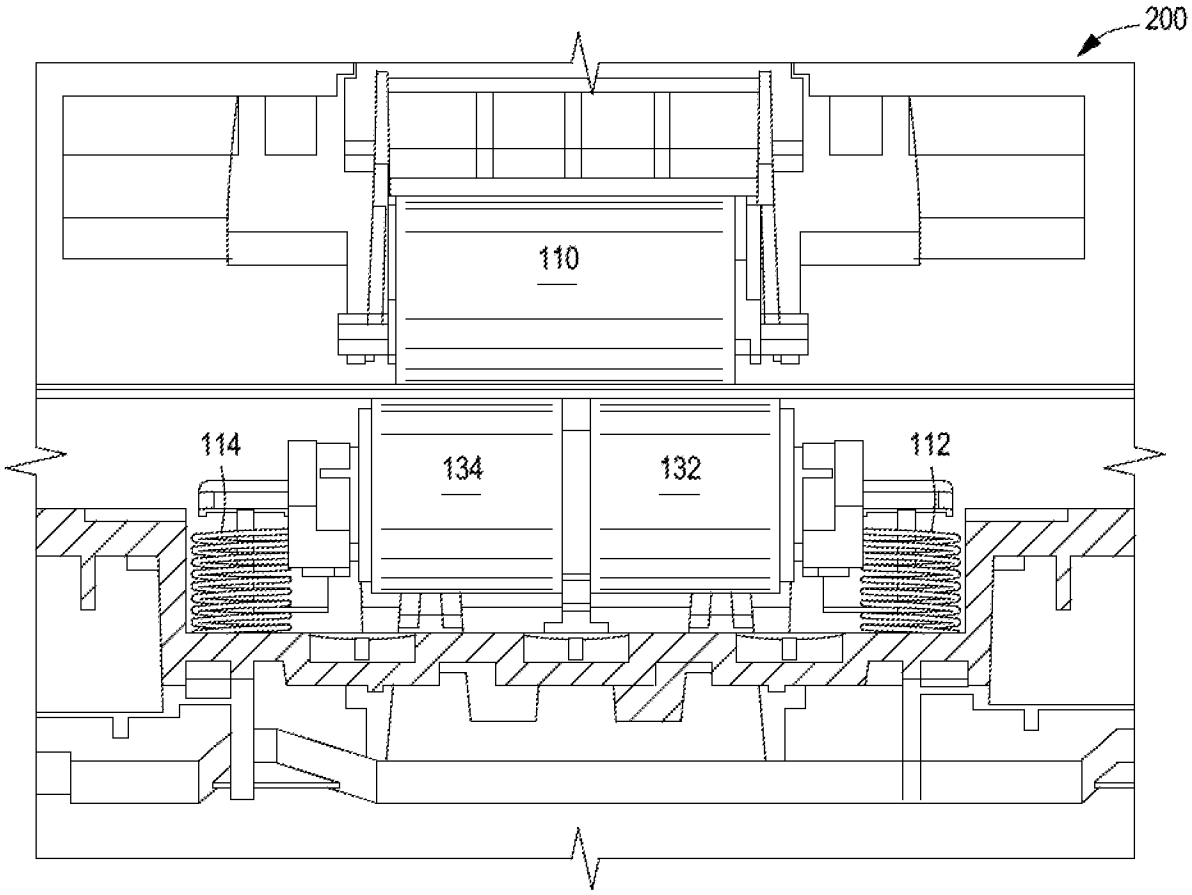
FIG. 6 is a top schematic view of a device including a top view of a separation unit according to an example.

FIG. 6 is a top schematic view of a device 20 including a top view of a separation unit 200 according to an example. In the example of FIG. 6, separation unit 200 includes a roller 110, a separator 132, a separator 134, a spring 112, and a spring 114. In examples, medium 5 travels along media travel direction 50 (not shown) and exits separation unit 200 after passing between roller 110 and separator 132 and/or separator 134. In the example of FIG. 6, similarly numbered elements are substantially similar to elements described above with respect to FIGS. 1-5.

In the example of FIG. 6, separator 132 and separator 134 are rollers to contact medium 5. In some examples, separator 132 and separator 134 may be any type of roller, such as a drag roller, a driven roller, a clutch driven roller, etc. In an example, separator 132 and separator 134 may rotate about a center axis in a direction opposite to the direction that roller 110 rotates about its center axis. Separator 132 and separator 134 are coupled to spring 112 and spring 114, respectively. In such an example, separator 132 and separator 134 may provide a separation force to medium 5 in combination with roller 110 such that medium 5 may separate from media 15 (not shown).

In the examples, separator 132 and separator 134 are independent rollers. In such an example, a force applied by separator 132 to medium 5 is independent of separator 134. Similarly, a force applied by separator 134 to medium 5 is independent of separator 132. In examples, spring 112 and spring 114 may be chosen to optimize the separation force applied by separator 132 and separator 134, respectively. The separation force applied by separator 132 and/or separator 134 may be sufficient to separate medium 5 from media 15. As described with respect to FIGS. 1-5, one of separator 132 or separator 134 may continue to apply a separation force to medium 5 if the other separator fails to provide sufficient separation force to medium 5.

Figure 7:
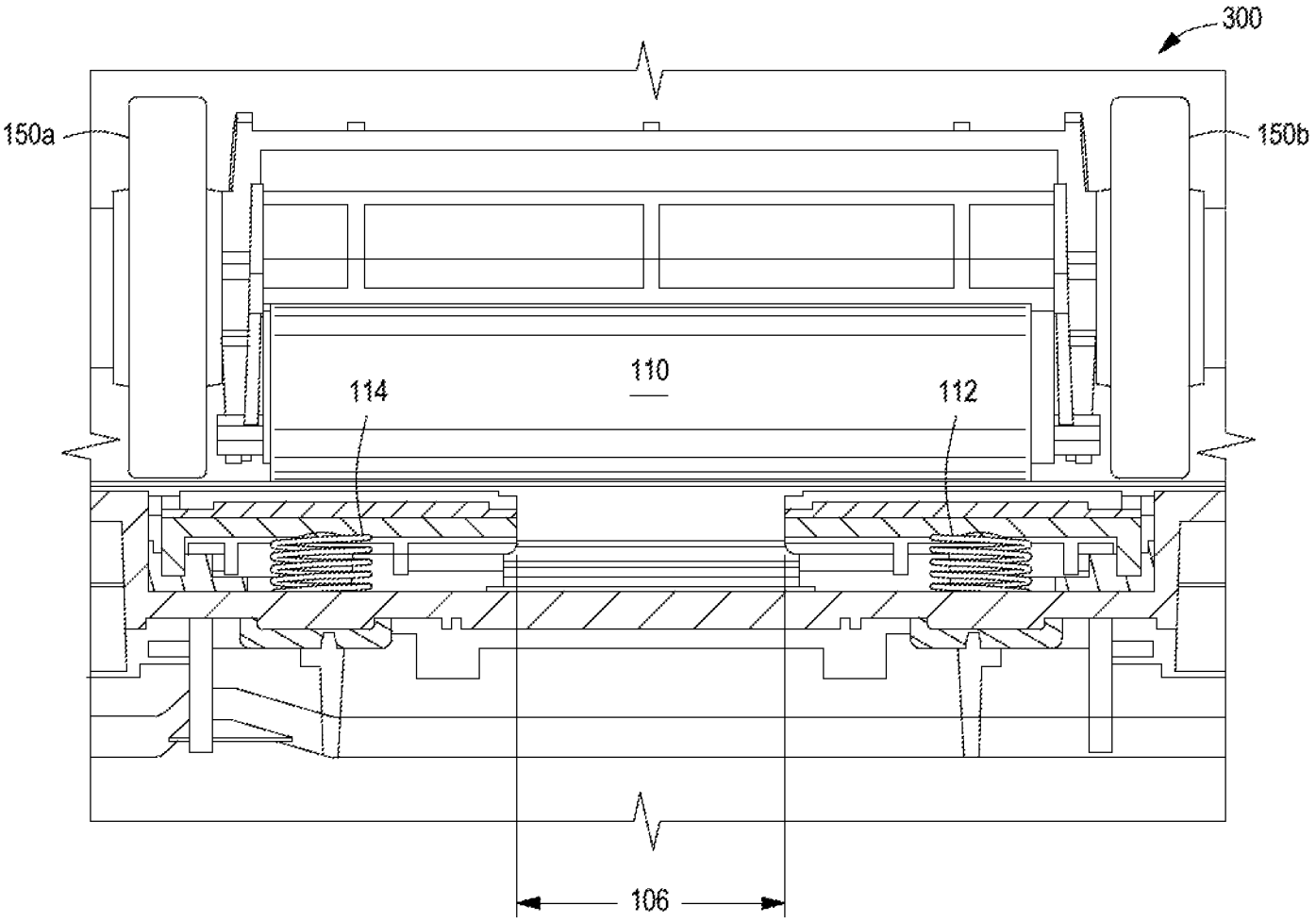
FIG. 7 is a top schematic view of a device including a top view of a separation unit according to an example.

FIG. 7 is a diagram of a device including a schematic top perspective view of a separation unit 300, according to an example. In the example of FIG. 7, separation unit 300 includes a roller 110, a roller 150*a*, a roller 150*b*, a separator 102, a separator 104, a spring 112, and a spring 114. In examples, medium 5 travels along media travel direction 50 (not shown) and exits separation unit 300 after passing between roller 110 and separator 102 and/or separator 104. In the example of FIG. 7, similarly numbered elements are substantially similar to elements described above with respect to FIGS. 1-6.

In the example of FIG. 7, roller 110 may be coupled to roller 150*a* and roller 50*b*. Roller 150*a* and roller 150*b* may each be an idle roller coupled to roller 110. In examples, a motor may drive roller 110, roller 150*a*, and roller 150*b* about respective central axes. Although described with respect to FIG. 7, roller 150*a* and roller 150*b* may also be used in separation unit 100 described above with respect to FIGS. 1-5 or separation unit 200 described above with respect to FIG. 6. In an example, a single roller from among roller 150*a* and roller 150*b* may be coupled to roller 110. In some examples, roller 150*a* and or roller 150*b* may contact medium 5 to provide a separation force in combination with roller 110, separator 102, and separator 104 to separate medium 5 from media 15 (not shown). However, the examples are not limited thereto and medium 5 may not contact roller 150*a* and/or roller 150*b* as it travels along media travel direction 50 (not shown).

While certain implementations have been shown and described above, various changes in form and details may be made. For example, some features that have been described in relation to one implementation and/ or process can be related to other implementations. In other words, processes, features, components, and/or properties described in relation to one implementation can be useful in other implementations. Furthermore, it should be understood that the systems, apparatuses, and methods described herein can include various combinations and/or sub-combinations of the components and/or features of the different implementations described. Thus, features described with reference to one or more implementations can be combined with other implementations described herein.

The above discussion is meant to be illustrative of the principles and various embodiments of the present disclosure. Numerous variations and modifications will become apparent to those skilled in the art once the above disclosure is fully appreciated. It is intended that the following claims be interpreted to embrace all such variations and modifications.

What is claimed is:

1. A device, comprising:

a first separator having a first surface to contact a first side of a medium, the first separator having a first centerline in a direction perpendicular to a medium travel direction;

a second separator having a first surface to contact the first side of the medium, the second separator having a second centerline in the direction perpendicular to the medium travel direction, the second centerline disposed substantially parallel to the first centerline;

a roller to contact a second surface of the medium, the roller to move the medium along the medium travel direction;

a first spring coupled to the first separator to bias the first separator towards the roller; and a second spring coupled to the second separator to bias the second separator towards the roller simultaneously with the first spring biasing the first separator towards the roller, wherein a first force applied by the first separator to the medium is independent of a second force applied to the medium by the second separator, and the first separator and the second separator are aligned with the roller in the medium travel direction to pinch the medium between the roller and one or both of the first separator and the second separator.

2. The device of claim 1, wherein the first separator and the second separator are each a separation pad.

3. The device of claim 1, wherein in the first separator and the second separator are each a drag roller.

4. The device of claim 1, wherein in the first separator and the second separator are each a driven roller.

5. The device of claim 1, wherein in the first separator and the second separator are substantially the same size and shape.

6. A device, comprising:

a first separator to contact a first surface of a medium including, the first separator having a first edge perpendicular to a medium travel direction;

a second separator to contact the first surface of the medium, the second separator having a second edge perpendicular to the medium travel direction, the second edge positioned substantially parallel to the first edge;

a roller to contact a second surface of the medium, the roller to move the medium along the medium travel direction;

a first spring coupled to the first separator to bias the first separator towards the roller; and a second spring coupled to the second separator to bias the second separator towards the roller simultaneously with the first spring biasing the first separator towards the roller, wherein a first force applied by the first separator to the medium is independent of a second force applied to the medium by the second separator, and the first separator and the second separator are aligned with the roller in the medium travel direction to pinch the medium between the roller and one or both of the first separator and the second separator.

7. The device of claim 6, further comprising:

an idle roller coupled to the roller to move the medium along the medium travel direction.

8. The device of claim 6, wherein in the first separator and the second separator are substantially the same size and shape.

9. The device of claim 6, wherein a distance between the first separator and the second separator is less than or equal to 20 mm.

10. The device of claim 6, wherein a distance between the first separator and the second separator is more than 20 mm.

11. A device comprising, a first separator to contact a first surface of a medium including, the first separator having a first edge perpendicular to a medium travel direction;

a second separator to contact the first surface of the medium, the second separator having a second edge perpendicular to the medium travel direction, the second edge positioned substantially parallel to the first edge;

a first roller to contact a second surface of the medium, the first roller to move the medium along the medium travel direction;

a second roller coupled to the first roller to move the medium along the medium travel direction;

a first spring coupled to the first separator to bias the first separator towards the first roller; and a second spring coupled to the second separator to bias the second separator towards the first roller simultaneously with the first spring biasing the first separator towards the first roller, wherein a first force applied by the first separator to the medium is independent of a second force applied to the medium by the second separator and the first separator and the second separator are aligned with the roller in the medium travel direction to pinch the medium between the roller and one or both of the first separator and the second separator.

12. The device of claim 11, wherein in the first separator and the second separator are substantially the same size and shape.

13. The device of claim 11, wherein a distance between the first separator and the second separator is less than or equal to 20 mm.

14. The device of claim 11, wherein a distance between the first separator and the second separator is more than 20 mm.

15. The device of claim 11, wherein a spring force applied to the first separator is not applied to the second separator.

* * * * *